United States Patent [19]

Rohner et al.

[11] 4,441,308

[45] Apr. 10, 1984

[54] THREAD SPLICING DEVICE

[75] Inventors: Joachim Rohner; Heinz Zumfeld; Reinhard Mauries, all of Monchen-Gladbach, Fed. Rep. of Germany

[73] Assignee: W. Schlafhorst & Co., Monchen-Gladbach, Fed. Rep. of Germany

[21] Appl. No.: 346,881

[22] Filed: Feb. 8, 1982

[30] Foreign Application Priority Data

Feb. 7, 1981 [DE] Fed. Rep. of Germany ..... 3104367

[51] Int. Cl.[3] ..... B65H 69/06; D01H 15/00; D02J 1/08

[52] U.S. Cl. ..... 57/22

[58] Field of Search ..... 57/22, 23, 202, 261, 57/350; 28/271–276

[56] References Cited

U.S. PATENT DOCUMENTS 3,306,020 2/1967 Rosenstein ..... 57/22

3,345,809 10/1967 Gemeinhardt et al. ..... 57/22

3,477,217 11/1969 Bell et al. ..... 57/22

*Primary Examiner*—John Petrakes

*Attorney, Agent, or Firm*—Herbert L. Lerner; Laurence A. Greenberg

[57] ABSTRACT

Thread splicing device, including a stationary base body having a compressed air conduction channel formed therein, a splicing head being exchangeably connected to the base body and having a splicing chamber for inserting and joining threads being formed therein, the splicing head having a compressed air conduction channel being formed therein in communication with the compressed air conduction channel in the base body and terminating in the splicing chamber, and the splicing head having at least one air outlet slit being formed therein at an inclination relative to the longitudinal axis of the splicing chamber and being in connection with the compressed air conduction channel formed therein at the splicing chamber, and a cover for temporarily covering the splicing chamber.

10 Claims, 8 Drawing Figures

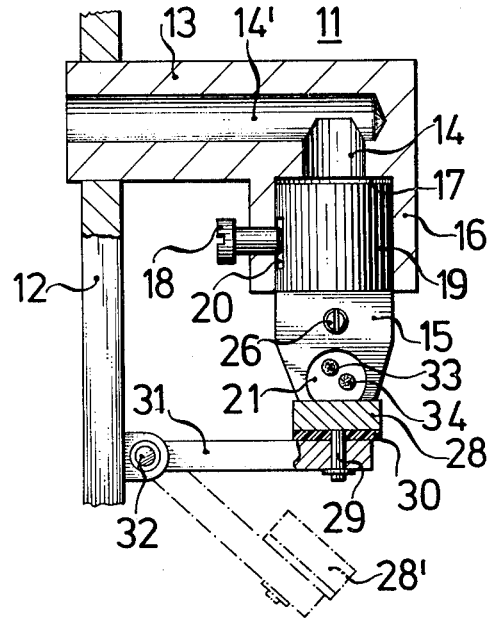
FIG. 1
FIG. 3
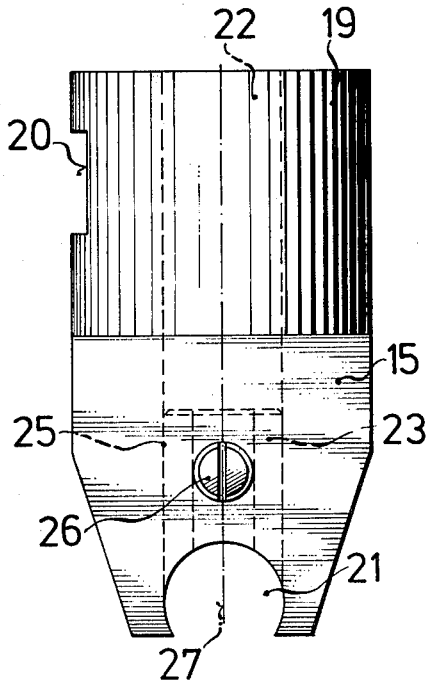
FIG. 2
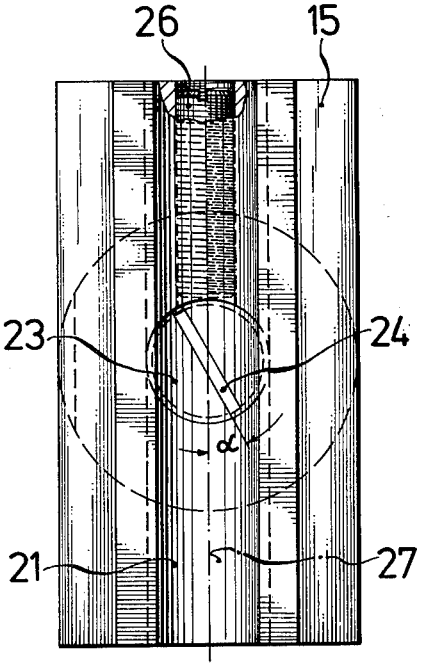

FIG.7
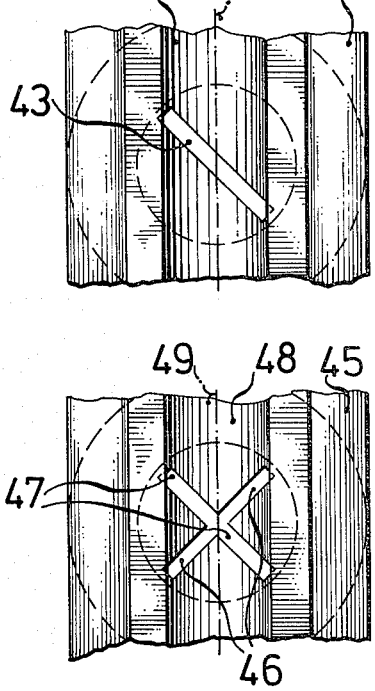
FIG.4
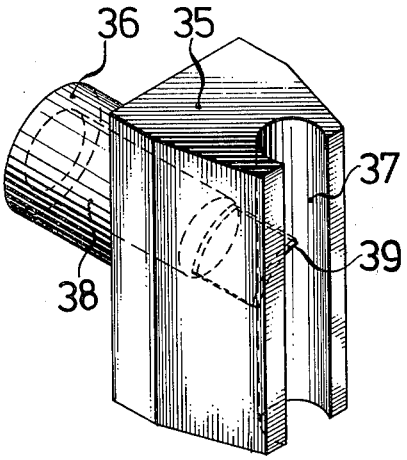
FIG.8
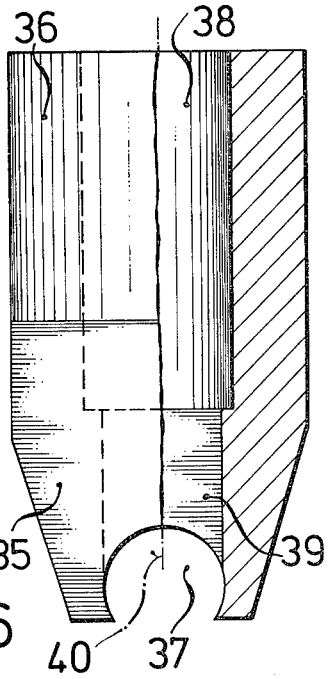
FIG.6
FIG.5
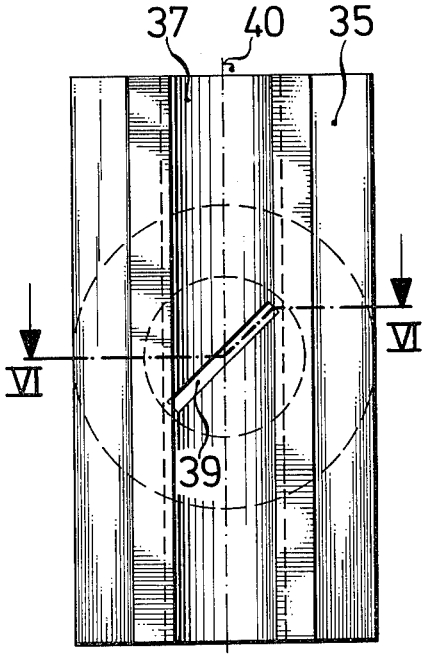

THREAD SPLICING DEVICE

The invention relates to a thread splicing device with a splicing head which includes a splicing chamber with an optionally coverable longitudinal slot for inserting and joining the threads, a compressed air channel opening into the splicing chamber, and an optional cover for temporarily covering the longitudinal slot.

Since the possibilities for using the known thread splicing devices are limited and the same splicing head cannot be used very well for different threads and yarns, such as long-staple yarns, short-staple yarns, or for different yarn thicknesses and different yarn twists, it has already been proposed in U.S. patent application Ser. No. 225,636, filed Jan. 16, 1981 and now abandoned, to provide a stationary base body with a channel carrying compressed air, and to connect the splicing head to the base body so that it is easily interchangeable.

It is accordingly an object of the invention to provide a thread splicing device which overcomes the hereinafore-mentioned disadvantages of the heretofore-known devices of this general type, and in which the splicing heads are not only easy to interchange, but in which each individual splicing head is already adjusted or is adjustable for effective splicing of yarns, twines and threads of a specified twist.

The basic concept of the invention lies in the provision that the shape, cross section, arrangement, orientation and entrance of the compressed air channel or blow-opening, are optimally adapted to the twist of the threads which are to be connected with each other.

With the foregoing and other objects in view there is provided, in accordance with the invention, a thread splicing device, comprising a stationary base body having a compressed air conduction channel formed therein, a splicing head being easily exchangeably connected to the base body and having a splicing chamber with a longitudinal slot for inserting and joining threads being formed therein, the splicing head having a compressed air conduction channel being formed therein in communication with the compressed air conduction channel in the base body and terminating in the splicing chamber, and the splicing head having at least one air outlet slit being formed therein at an inclination or obliquely relative to the longitudinal axis of the splicing chamber and being in connection with the compressed air conduction channel formed therein at the splicing chamber, and a cover for temporarily covering the splicing chamber.

This proposal opens up several possibilities for optimal splicing. First, by forming air outlet slits so as to be distributed along the longitudinal slot, it is possible to form individual splices at greater or lesser distances from each other. Secondly, with very strongly twisted yarns, the yarn twist can be more advantageously loosened by suitable air turbulences; this is especially so if, in accordance with another feature of the invention, the air outlet slit is evenly disposed on two sides i.e. left and right, of a plane of symmetry passing lengthwise through the splicing chamber or longitudinal slot and intersects or cuts the plane of symmetry at an acute angle. The magnitude of this angle depends on the amount or pitch of thread-twist, and the direction of the air outlet slit depends on the way the thread is twisted.

An important advantage of the invention is that it produces stronger splice connections.

In accordance with a further feature of the invention, the compressed air conduction channel in the splicing head has a given open or free cross section being greater than the open cross section of the at least one air outlet slit or sum of the slits. In this way, discontinuities are provided at the transition into the air outlet slits, which cause advantageous air turbulences. The pressure drop of the compressed air channel therefore does not interfere with the splicing operation.

In accordance with an added feature of the invention, the compressed air conduction channel in the splicing head has a cross section having a different shape than that of the at least one air outlet slit or slits. In this way, there is also a discontinuity created at the transition into the air outlet slits, thereby eliminating the requirement of the free cross section having a different size.

A universal operational capability is achieved, for threads with an S-twist as well as for Z-twist threads if, in accordance with an additional feature of the invention, the at least one air outlet slit is in the form of two air outlet slits crossing each other. The change-over of the thread splicing device to threads with a different twist need not necessarily be accomplished by exchanging the splicing head if, in accordance with again another feature of the invention, the splicing head includes an interchangeable insert member having the at least one air outlet slit or slots formed therein, the insert member being disposed between the compressed air conduction channel and the splicing chamber. By a simple rotation of the insert member the outlet angle as well as the exit direction of the air outlet slits can be adjusted or changed, according to the twist of the respective yarn. This offers the possibility of setting the direction of the air outlet slits by adjusting the insert member with sufficient accuracy with regard to the respective twist of the thread.

For example, an insert piece could be made with four corners, or in general as a polygonal insert piece. Depending on the number of surfaces of the polygon, a corresponding number of change-overs and direction changes could be effected. However, it is better if, in accordance with again a further feature of the invention, the insert member is in the form of a turned body, and in accordance with again an added feature of the invention, the splicing head has a matching seat in the form of a recess or turned bore formed therein for receiving the insert member. In this case the adjustment is performed without steps. However, a polygonal insert member is sometimes also advantageous, because an absolutely uniform setting of a great number of parallel operating splicing devices can be effected more quickly and easily therewith.

In order not to lose the position of the insert member once it has been established, in accordance with a concomitant feature of the invention, there is provided a fastening element for holding the insert member in place. For example, the fastener can be a set-screw.

The invention provides an expert with the capability of arranging the air flow during the splicing operation in such a way that it is adapted overall to the diameter, cross section, volume, number, kind of twist, pitch of twist, type of fiber, fiber length, fiber structure, surface structure of the fibers, surface roughness of the fibers, staple length, surface structure of the thread, thread roughness and/or moisture content, degree of electrostatic charge, sizing content and content of foreign bodies of the threads to be joined together, in an optimum manner.

Other features which are considered as characteristic for the invention are set forth in the appended claims.

Although the invention is illustrated and described herein as embodied in a thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, partially cross-sectional and partially broken away view of a device according to the invention;

FIG. 2 is a front-elevational view, partly broken away, of a splicing head according to a first embodiment of the invention;

FIG. 3 is a side-elevational view of the splicing head of FIG. 2;

FIG. 4 is a diagrammatic perspective view of a second embodiment of the splicing head according to the invention;

FIG. 5 is a front-elevational view of FIG. 4;

FIG. 6 is a partially cross-sectional side-elevational view taken along the line VI—VI in FIG. 5, in the direction of the arrows;

FIG. 7 is a fragmentary front-elevational view of a third embodiment of the invention; and FIG. 8 is a fragmentary front-elevational view similar to FIG. 7 of a fourth embodiment of the invention.

Referring now to the figures of the drawing and first particularly to FIG. 1 thereof, there is seen a thread splicing device 11 which is only shown in its essential details, and a frame 12 which carries a base body 13. The base body 13 contains an angular channel 14, 14' for compressed air. Furthermore, the base body 13 is provided with holding means for a splicing head 15, including a core or an eye 16 with a receiving bore 17, and a holding element in the form of a fastening screw 18 for the splicing head 15. The counterpart of this holding device is provided at the splicing head 15 in the form of a cylindrical plug-in base 19, which has a flat 20 that is directed toward the holding element 18. The splicing head 15 has a splicing chamber formed therein in the form of a longitudinal or transverse slot 21. A compressed air channel 22 shown in dotted lines in FIG. 3, leads through the plug-in base 19 up to the vicinity of the longitudinal slot 21, where it ends at an insert member 23, which is especially clearly shown in FIGS. 2 and 3. An air outlet slit 24 is provided in the insert member 23. Hence, the air outlet slit 24 terminates at one side thereof in the compressed air channel 22, and at the other side thereof in the splicing chamber or longitudinal slot 21.

The insert member 23 is a turned cylindrical body, having a mating receptacle 25 being formed with contours that are shown in FIG. 3 by dotted lines, and being in the form of a cylindrical bore or recess. Thus, the insert 23 is rotatably held in its receiving bore 25, and is arrested by a fastener 26 in its position. The fastening element 26 is in the form of a set-screw.

It can be clearly seen that the air outlet slit 24 has a smaller free or open cross-section than the compressed air channel 22 in the splicing head 15. The air outlet slit 24 also has a different cross-sectional form or shape than the compressed air channel 22.

The air outlet slit 24 is disposed in such a way as to be distributed to the left and to the right of a symmetry plane 27 passing through the length of the longitudinal slot 21, and the slit 24 cuts through the symmetry plane at an acute angle alpha. The inclined (oblique) orientation of the air outlet orifice 24 is chosen or adjusted in such a way that threads having an S-twist can be successfully spliced.

FIG. 1 shows that the splicing head 15 can be covered by a pivotable cover 28. The cover 28 has a smooth surface facing toward the longitudinal slot 21. The cover 28 is flexibly fastened to a cover holder 31 by means of a holding device 29 with the interposition of a resilient plastic plate 30. The cover holder 31 is pivotably supported in a pivot joint 32 at the frame 12. The cover 28 can be opened for inserting two threads 33 and 34, which are to be spliced to each other, into the longitudinal slot 21. The cover 28 can be hinged or swung, for example, to the position 28', shown in phantom. The two threads 33, 34 are shown in cross-section in FIG. 1. In the other figures a pictorial presentation of the threads has been omitted.

Threads coming from opposite sides are inserted into the longitudinal slot 21 in such a manner that their thread endings still extend beyond the longitudinal slot. For splicing, the cover is closed, and the compressed air is admitted for a prescribed time into the channel 14'. The compressed air escapes from the air outlet slit 24, intertwines the two threads and their fibers while loosening their twist, and forms the splice. After the air supply is cut off, the cover is opened, the threads are taken out of the splicing chamber 21, and the thread ends which protrude out are severed near the spliced portion.

If, in the typical embodiment according to FIGS. 1, 2 and 3, it is desired to give the air outlet slit a different position or direction, one must first loosen the fastening element 26. The insert member 23 can thereafter be moved to the desired position by means of a screwdriver which is inserted into the air outlet slit 24. The fastening element 26 is then secured again.

In contrast to the first embodiment, in the second typical embodiment according to FIGS. 4, 5 and 6, no provision has been made for adjusting the position of the outlet slit. In this embodiment there is also seen a splicing head 35 having a cylindrical plug-in member 36. The longitudinal slot 37 in the second embodiment also has a circular cross section. The cylindrical channel for the compressed air is connected with an air outlet slit 39 which is inclined with respect to the longitudinal axis of the splicing chamber 37. In this case as well, the air outlet slit 39 is disposed in such a way as to be evenly distributed to the left and to the right of a symmetry plane 40 which passes through the length of the longitudinal slot 37. The slit 39 also cuts the symmetry plane 40 at an acute angle.

In contrast to the first embodiment, the air outlet slit 39 has a different orientation, whereby the splicing head 35 is suited for splicing threads with a Z-twist.

The embodiment according to FIG. 7 is the counterpart to the embodiment according to FIGS. 4, 5 and 6. The fragmentary view of a splicing head 41 with a longitudinal slot 42 shown in FIG. 7, has an air outlet slit 42 pointing toward the left, which is evenly disposed to the left and to the right of a symmetry plane 44 that passes through the length of the longitudinal slot 42, and cuts the symmetry plane at an acute angle. This embodiment is especially suited for threads with an S-twist.

The embodiment according to FIG. 8 is suited for threads with a Z-twist, with an S-twist, and also for threads without a twist or with only a slight twist. In this case, the splicing head 45 has two air outlet slits 46 and 47 which cross each other. The air outlet slits cross at angles of 90 degrees, and lie in symmetrical relation to a symmetry plane 49 passing through the length of the longitudinal slot 48.

In all of the embodiments, the edges of the longitudinal slot should be rounded and smooth. This is especially pointed out, because it is not directly visible in the diagrammatic representations.

As mentioned above, the invention is not limited to the embodiments described and shown in the figures.

We claim:

1. Thread splicing device, comprising a stationary base body having a compressed air conduction channel formed therein, a splicing head exchangeably connected to said base body and formed with an elongated splicing chamber wherein threads are insertable for joining, said elongated splicing chamber having a longitudinal axis, said splicing head having a compressed air conduction channel formed therein in communication with said compressed air conduction channel in said base body and terminating in said splicing chamber, and said splicing head having at least one air outlet slit formed therein at an inclination relative to the longitudinal axis of said splicing chamber and located at the terminus of said compressed air conduction channel in said splicing chamber, and a cover for temporarily covering said splicing chamber.

2. Thread splicing device according to claim 1, wherein said air outlet slit is evenly disposed on two sides of a plane of symmetry passing longitudinally through said splicing chamber and intersects the plane of symmetry at an acute angle.

3. Thread splicing device according to claim 1 or 2, wherein said compressed air conduction channel in said splicing head has a given open cross section being greater than the open cross section of said at least one air outlet slit.

4. Thread splicing device according to claim 1 or 2, wherein said compressed air conduction channel in said splicing head has a cross section having a different shape than that of said at least one air outlet slit.

5. Thread splicing device according to claim 1, wherein said at least one air outlet slit is in the form of two air outlet slits crossing each other.

6. Thread splicing device according to claim 1, wherein said splicing head includes an interchangeable insert member having said at least one air outlet slit formed therein, said insert member being disposed between said compressed air conduction channel and said splicing chamber.

7. Thread splicing device according to claim 6, wherein said insert member is in the form of a turned body.

8. Thread splicing device according to claim 6 or 7, wherein said splicing head has a recess formed therein for receiving said insert member.

9. Thread splicing device according to claim 8, including a fastening element for holding said insert member in place.

10. Thread splicing device according to claim 6 or 7, including a fastening element for holding said insert member in place.

* * * * *